US011040923B2

(12) United States Patent
Skeats et al.

(10) Patent No.: US 11,040,923 B2
(45) Date of Patent: Jun. 22, 2021

(54) EXPLOSIVE COMPOSITION FOR USE IN TELESCOPICALLY EXPANDING NON-LETHAL TRAINING AMMUNITION

(71) Applicant: UTM IP LIMITED, Mildenhall Suffolk (GB)

(72) Inventors: Martin Skeats, Mildenhall Suffolk (GB); Michael Ernest Saxby, Eastbourne (GB); Adam Collins, Los Angeles, CA (US); David Martin Williamson, Cambridge (GB)

(73) Assignee: UTM Ltd., Mildenhall (GB)

( * ) Notice: Subject to any disclaimer, the term of this patent is extended or adjusted under 35 U.S.C. 154(b) by 0 days.

(21) Appl. No.: 16/148,657

(22) Filed: Oct. 1, 2018

(65) Prior Publication Data

US 2019/0135712 A1 May 9, 2019

Related U.S. Application Data

(62) Division of application No. 14/761,167, filed as application No. PCT/EP2014/050720 on Jan. 15, 2014, now abandoned.

(30) Foreign Application Priority Data

Jan. 17, 2013 (GB) ..... 1300839.6

(51) Int. Cl.
*C06B 43/00* (2006.01)
*C06B 23/00* (2006.01)
(Continued)

(52) U.S. Cl.
CPC ..... *C06B 43/00* (2013.01); *C06B 23/005* (2013.01); *C06B 45/00* (2013.01); *F42B 5/045* (2013.01); *F42B 5/16* (2013.01); *F42B 8/02* (2013.01)

(58) Field of Classification Search
CPC ..... C06B 43/00; C06B 23/005; C06B 23/006; C06B 41/00; C06B 41/10; C06B 45/02;
(Continued)

(56) References Cited

U.S. PATENT DOCUMENTS 3,994,201 A 11/1976 Bendler et al.
4,372,210 A 2/1983 Shaffer et al.
(Continued)

FOREIGN PATENT DOCUMENTS

DE 1903163 A1 * 9/1969 ..... G03C 1/54
EP 1707547 A2 10/2006
(Continued)

OTHER PUBLICATIONS

International Search Report and Written Opinion, PCT/EP2014/050720, dated May 28, 2014, pp. 1-12.
(Continued)

*Primary Examiner* — Stephen Johnson
(74) *Attorney, Agent, or Firm* — Nelson Mullins Riley & Scarborough LLP; Anthony A. Laurentano

(57) ABSTRACT

An explosive composition for use in telescopically expanding non-lethal training ammunition comprises tetrazene and paraffin wax. The explosive composition can be used as a primer and/or as a source of energetic material in a telescopically expanding non-lethal training cartridge; it can be used to propel a projectile from a telescopically expanding non-lethal training cartridge; and/or it can be used to expand telescopically a non-lethal training cartridge within a host gun.

15 Claims, 7 Drawing Sheets

(51) Int. Cl.

| | |
|---|---|
| ***F42B 5/045*** | (2006.01) |
| ***F42B 5/16*** | (2006.01) |
| ***C06B 45/00*** | (2006.01) |
| ***F42B 8/02*** | (2006.01) |

(58) Field of Classification Search
CPC .. C06B 45/04; F42B 5/045; F42B 5/16; F42B 8/02
See application file for complete search history.

(56) References Cited

U.S. PATENT DOCUMENTS

| | | | | |
|---|---|---|---|---|
| 4,430,132 | A | 2/1984 | Painter | |
| 4,747,892 | A | 5/1988 | Spencer | |
| 5,250,161 | A | 10/1993 | Chin et al. | |
| 6,610,644 | B1 | 8/2003 | Fenney et al. | |
| 2005/0183805 | A1* | 8/2005 | Pile | C06C 7/00 149/39 |
| 2006/0219341 | A1* | 10/2006 | Johnston | C06B 33/08 149/46 |
| 2009/0298971 | A1 | 12/2009 | Leotsakos et al. | |
| 2012/0042560 | A1* | 2/2012 | Jackson | F41A 33/02 42/116 |

FOREIGN PATENT DOCUMENTS

| | | | |
|---|---|---|---|
| GB | 1062179 | A | 3/1967 |
| WO | 01/16550 | A1 | 3/2001 |
| WO | 2004/063128 | A1 | 7/2004 |
| WO | 2005/054775 | A1 | 6/2005 |
| WO | 2007/096529 | A1 | 8/2007 |
| WO | 2007/119038 | A1 | 10/2007 |

OTHER PUBLICATIONS

Collins, A. et al., "Passivated tetrazene for use in small-scale impact-sensitive gas generators," New Trends in Research of Energetic Materials, Proceedings of the Seminar, 15TH, Pardubice, Czech Republic, Apr. 18-20, 2012, Abstract only.

* cited by examiner

EXPLOSIVE COMPOSITION FOR USE IN TELESCOPICALLY EXPANDING NON-LETHAL TRAINING AMMUNITION

RELATED APPLICATIONS

This application is a divisional of U.S. application Ser. No. 14/761,167 filed on 15 Jul. 2015, now abandoned, which is a 35 U.S.C. 371 national stage filing of International Application PCT/EP2014/050720, filed 15 Jan. 2014, which claims priority to GB 1300839.6 filed on 17 Jan. 2013 in Great Britain. The contents of the aforementioned applications are hereby incorporated by reference.

BACKGROUND OF THE INVENTION

The present invention relates to an improved explosive composition, and its use in telescopically expanding non-lethal training ammunition.

The applicant's earlier published patent application WO 01/16550 describes telescopically expanding non-lethal training ammunition.

A major problem found in the design of this type of ammunition is that the impact explosives commonly available in conventional ammunition primers are very energetic and difficult to control. Most of the commonly available impact explosives used in conventional ammunition primers are also toxic.

It has been found that in currently available telescopically expanding non-lethal training ammunition, the violent expansion of the currently available impact explosives provides pressures that can damage the host gun, and yet during cycling of the host gun the pressure reduces to levels that fail to fully cycle the host gun causing jammed rounds.

It has also been found that using the currently available impact explosives and other conventional propellants for firing low energy bullets, the velocity of the bullet is difficult to control and poor standard deviations in the bullets' velocity can cause either injury at the higher velocities or barrel jams in the gun at the lower velocities.

Typical explosives that are sensitive to input stimuli are often based on heavy metal compounds. In priming mixtures, lead 2,4,6-trinitroresorcinate (commonly referred to as 'lead styphnate') and lead azide are the most widely used, owing to their long-term stability, appropriate explosive output and production of non-corrosive reaction products. Pyrotechnic mixtures often contain heavy-metal oxidisers, such as barium nitrate, lead dioxide, lead tetroxide (commonly referred to as 'red lead'), and antimony sulfide (commonly referred to as 'stibnite'). However, the toxicity of these materials and their reaction products is problematic. For instance, small arms firing ranges are often found to have unacceptably high levels of lead compounds in the air. The role of heavy metal compounds in primary explosives and ignition mixtures is to provide suitably weak-bonding for sensitivity, and provide reaction products that are hot, lubricating, and non-corrosive. It is difficult to achieve this level of functionality without including heavy metal compounds in such explosives.

As an alternative to heavy metal compounds, perchlorate salts have also been used in gas-generating mixtures, but concerns have now been raised about their toxicity. Accordingly, there is a need to provide alternative gas-generators as a suitable non-toxic replacement for both perchlorate salts and heavy metal compounds.

SUMMARY OF THE INVENTION

The present invention seeks to provide an improved impact explosive such that the gas generated can be controlled to provide a more reliable velocity and lower standard deviation of the low energy bullet, in order to reduce the aggressiveness of the telescopic expansion of the low energy training cartridge so that it cycles the host gun more reliably. The present invention also seeks to provide an improved impact explosive that is non-toxic, being substantially free from perchlorate salts and metal compounds, particularly heavy metal compounds.

In accordance with the present invention, there is provided an improved explosive composition for use in telescopically expanding non-lethal training ammunition which comprises tetrazene and paraffin wax.

The explosive composition of the present invention has been found to have a number of advantages, including providing a more consistent gas production process, which results in more consistent propulsion velocities and reliable cycling of the host gun. The explosive composition and its decomposition products are also non-toxic.

BRIEF DESCRIPTION OF THE DRAWINGS

The invention will be described with reference to the following figures in which.

DETAILED DESCRIPTION

Figure 1:
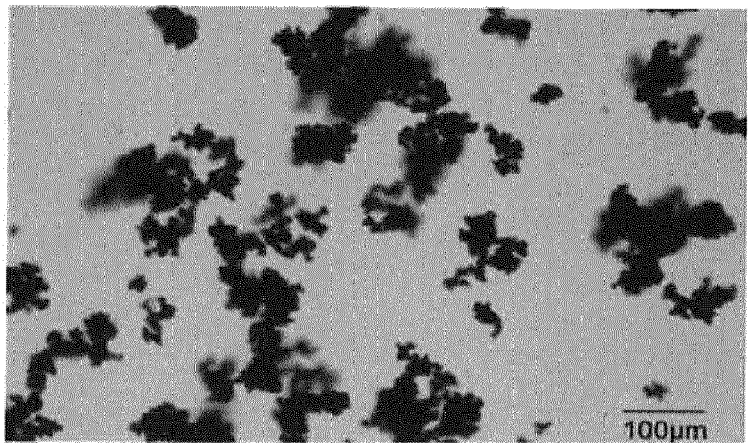
FIG. 1 shows a microscope image of synthesised tetrazene crystals.

The present invention provides an explosive composition for use in telescopically expanding non-lethal training ammunition which comprises tetrazene and paraffin wax.

The following definitions shall apply throughout the specification and the appended claims.

Embodiments have been described herein in a concise way. It should be appreciated that features of these embodiments may be variously separated or combined within the invention.

Within the context of the present specification, the term "comprises" is taken to mean "includes" or "contains", i.e. other integers or features may be present, whereas the term "consists of" is taken to mean "consists exclusively of".

Within the present specification, the term "about" means plus or minus 20%; more preferably plus or minus 10%; even more preferably plus or minus 5%; most preferably plus or minus 2%.

In the present specification, the term "substantially free from" in relation to a certain substance means at most 1% of that substance, more preferably at most 0.1% of that substance, even more preferably at most 0.01% of that substance, most preferably at most 0.001% of that substance.

Tetrazene (or tetracene) is the common name for 1-(5-tetrazolyl)-3-guanyl tetrazene hydrate, the compound of formula (I) shown below.

(I)

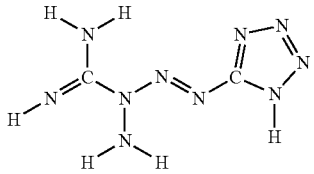

The chemical compound was discovered in 1910, and has been widely used as an ignition sensitiser in priming mixtures for many years. Tetrazene's high nitrogen content and high sensitivity to impact, friction and heat encourages its use in devices that require energetic output from a small stimulus. Tetrazene derives its sensitivity from the relatively long and weak C—N bond between the tetrazole ring and the 3-guanyltetrazene chain. With the high-nitrogen content of tetrazene, its decomposition products are nitrogen-rich, allowing it to be a good gas-generator. Tetrazene is known to have good ageing characteristics, e.g. with 99.9% purity over 8 years. However, tetrazene's low explosion temperature and high gas-generating ability as the major gas generating component of an explosive composition can only be fully utilised if its high sensitivity can be mitigated.

Passivation is a common technique for reducing the sensitivity and reaction rates of many explosives. However, until now, passivating agents for use with tetrazene have not been investigated to establish a suitable agent which could potentially reduce tetrazene's ignition sensitivity and fast decomposition rate, and thereby enable its use in various new applications.

It has now surprisingly been found that mixing paraffin wax with tetrazene effectively passivates tetrazene, thus reducing its ignition sensitivity and fast decomposition rate. The passivated tetrazene accordingly has utility as an effective explosive composition for use in telescopically expanding non-lethal training ammunition.

Paraffin wax typically has a melting point of around 65° C., and a heat capacity of 2.14-2.9 kJ $kg^{-1}$ $K^{-1}$. Its high heat capacity is exploited in applications such as insulation systems, where it is used to absorb and release heat slowly.

The paraffin wax performs a number of functions within the explosive compositions of the invention. Firstly, it binds the tetrazene crystals together, allowing the mixture to be pressed into shape. Secondly, the lubricating paraffin wax fills the boundaries between tetrazene crystals, reducing contact friction between the crystals, and thus reducing mechanical sensitivity. Thirdly, the paraffin wax, when mixed with tetrazene, acts to reduce large thermal gradients and thus inhibit hotspot formation, which is thermal in origin. Fourthly, during tetrazene decomposition, the paraffin wax acts to absorb heat from the decomposition reaction, and hence reduces the gas-production rate. Finally, following the decomposition reaction, unburned paraffin wax can also act as a lubricant, which is useful for continuous functioning of a projectile-launching system.

Preferably, the paraffin wax is present in the form of micro particles. Micro particles are used herein to mean particles of between 0.5 and 500 μm in diameter. Such micro particles can conveniently be prepared by spray-cooling or spray congealing of molten paraffin wax. Micro particles prepared by such processes may additionally be sieved through a mesh of an appropriate size, removing those particles that do not pass through the mesh, in order to ensure a maximum particle diameter. For example, the micro particles may be sieved through a 300 μm mesh, a 250 μm mesh, a 200 μm mesh, a 150 μm mesh, or a 100 μm mesh. In a preferred embodiment, the micro particles are sieved through a 200 μm mesh. The micro particles may also optionally be sieved through a mesh of an appropriate size, removing those particles passing through the mesh, in order to ensure a minimum particle diameter.

The paraffin wax micro particles typically have particle diameters in the range of about 5 μm to about 300 μm. For example, the particle diameters of the paraffin wax micro particles may be from about 5 μm, about 10 μm, about 15 μm, about 20 μm, about 30 μm, or about 50 μm. For example, the particle diameters of the paraffin wax micro particles may be up to about 100 μm, about 150 μm, about 200 μm, about 250 μm, or about 300 μm. In a preferred embodiment, the micro particles have particle diameters in the range of about 20 μm to about 200 μm.

Accordingly in one aspect, the present invention provides an explosive composition for use in telescopically expanding non-lethal training ammunition which comprises tetrazene and paraffin wax, wherein the paraffin wax is in the form of micro particles having particle diameters in the range of about 20 μm to about 200 μm.

The explosive composition may comprise the tetrazene and paraffin wax components in any amounts such that the tetrazene is effectively passivated and the resultant composition displays an appropriate pressure-time profile to give acceptable consistency of gas production. The amounts of the tetrazene and paraffin components required to display an appropriate pressure-time profile to give acceptable consistency of gas production may vary dependent on the type of low energy training cartridge in which the composition is to be used.

Compositions of tetrazene and paraffin wax of varying amounts may be prepared. The compositions may then be characterised by calculating the void-less fraction of paraffin wax, i.e. the fraction of the volume occupied by wax if the composition were pressed to the theoretical maximum density (TMD), an impractical solution because the powders have a lower pouring density. Therefore, the following conversion for volume to mass-fill-fraction was devised. For a percentage ε of wax, by void less volume, and a total mixture mass, M, the mass of wax and tetrazene in the mixture are:

$$m_w = \frac{\varepsilon\rho_w}{\varepsilon\rho_w + (100-\varepsilon)\rho t} M, \text{ and}$$

-continued $$m_t = \frac{(100-\varepsilon)\rho t}{\varepsilon\rho_w + (100-\varepsilon)\rho t} M;$$

Where m is mass, p is density and subscripts w and t refer to paraffin wax and tetrazene respectively.

Crystal density of Tetrazene=1.63 mg $mm^{-3}$.

Density of paraffin wax=0.84 mg $mm^{-3}$.

For example, the explosive composition may comprise from about 2% to about 35% of paraffin wax by mass of tetrazene. Thus, the explosive composition may comprise from about 1% to about 50% of paraffin wax by void less volume. In compositions containing more than about 50% of paraffin wax by void less volume, the tetrazene is not able to function as a gas generator. In compositions containing less than about 1% of paraffin wax by void less volume, the tetrzene is not sufficiently passivated and gas production is too rapid for the desired application in non-lethal training ammunition, leading to faster and/or less controlled velocities For example, the composition may comprise from about 1%, about 2%, about 2.5%, about 3%, about 3.5%, about 4%, or about 4.5% of paraffin wax by void less volume. The composition may comprise up to about 5.5%, about 6%, about 7%, about 8%, about 10%, about 15%, about 20%, about 30%, about 40%, or about 50% of paraffin wax by void less volume.

Accordingly, in one aspect, the present invention provides a composition comprising from about 2% to about 40% of paraffin wax by void less volume. Preferably, the composition comprises from about 2.5% to about 20% of paraffin wax by void less volume, from about 3% to about 15% of paraffin wax by void less volume, or from about 3.5% to about 10% of paraffin wax by void less volume. More preferably, the composition comprises from about 4% to about 8% of paraffin wax by void less volume. Most preferably, the composition comprises from about 4.5% to about 5.5% of paraffin wax by void less volume.

In one preferred aspect, the present invention provides a composition comprising about 5% of paraffin wax by void less volume. Such a composition is particularly effective for use in conjunction with a 9 mm man marker round.

As mentioned above, the compositions of the present invention are designed to be non-toxic. Accordingly, in one aspect, the present invention provides a composition that is substantially free from lead. In another aspect, the present invention provides a composition that is substantially free from heavy metals and heavy metal compounds. As used herein, heavy metals are understood to mean metals and semimetals (metalloids) that have been associated with contamination and potential toxicity or ecotoxicity, and includes lead, barium, antimony, arsenic, cadmium, cobalt, chromium, copper, mercury, manganese, nickel, tin, thallium, beryllium, selenium, zinc, and compounds thereof. In a further aspect, the present invention provides a composition that is substantially free from metals, semi-metals, metal compounds, and semi-metal compounds. In another aspect, the present invention provides a composition that is substantially free from perchlorate salts.

The tetrazene crystals and the paraffin wax micro particles may be combined using any conventional method of mixing or blending. Conveniently, the tetrazene crystals and the paraffin wax micro particles may be combined using a powder mixer.

The composition of the present invention may additionally contain amounts of other conventional additives that are commonly used in explosive compositions. Such additives may include binders, lubricants and/or dyes.

The present invention also provides a combination of a telescopically expanding non-lethal training cartridge, and an explosive composition of the invention. Suitable cartridges include those disclosed in WO 01/16550, which include two independent energetic sources, namely a primer and a source of energetic material. One of the energetic sources acts to initiate cycling of the reload mechanism and the other propels a projectile from the casing. In such cartridges, the explosive composition of the invention may advantageously be used as either the primer, or the source of energetic material, or both the primer and the source of energetic material.

Figure 5A:
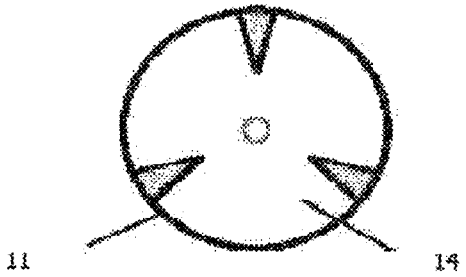
FIGS. 5A and 5B show a schematic of the packaged explosive composition for pressure measurement.
Figure 5B:
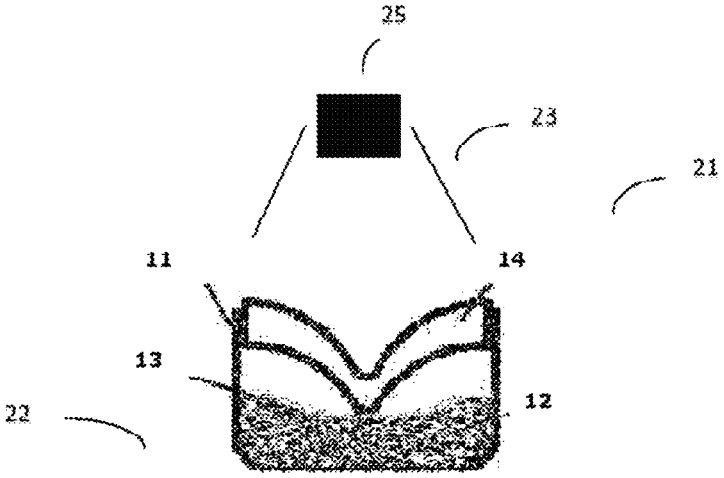

Accordingly, as shown by simplified example in FIG. 5B, the present invention provides a cartridge for use in non-lethal applications comprising an anterior portion 21 and a posterior portion 22, the posterior portion 22 comprising a recycling mechanism, the recycling mechanism being initiated on activation of a primer 11 and the anterior portion 21 being provided with a nose portion 23 which is suitable for receiving a projectile 25, characterised by a source of energetic material located in the anterior portion 21, the energetic material being initiatable by a reaction produced on activation of the primer to cause propulsion of the projectile 25 from the cartridge, wherein either the primer, or the source of energetic material, or both the primer and the source of energetic material comprise the explosive composition of the invention.

The present invention also provides the use of the explosive composition of the invention as a primer and/or as a source of energetic material in a telescopically expanding non-lethal training cartridge.

The present invention also provides the use of the explosive composition of the invention to propel a projectile from a telescopically expanding non-lethal training cartridge.

The present invention also provides the use of the explosive composition of the present invention to expand telescopically a non-lethal training cartridge within a host gun.

The present invention also provides a combination of a weapon, a telescopically expanding non-lethal training cartridge, and an explosive composition of the present invention.

The following Examples illustrate the invention.

Example 1: Tetrazene Synthesis

Figure 2:
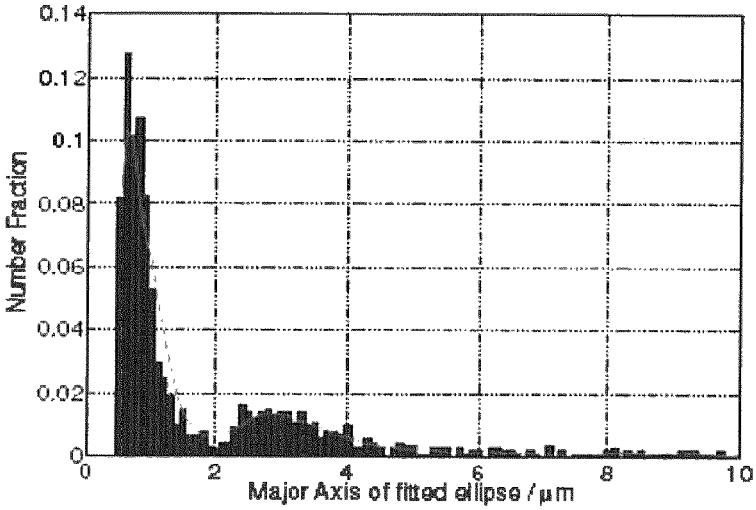
FIG. 2 shows the approximate particle size distribution of the synthesised tetrazene crystals.

A solution of sodium nitrite (1.68 g) and dextrin (6 mg) in distilled water (40 ml) was heated to 50-55 C.° with stirring. Tetrazene was synthesised by slow addition (control flow rate of 0.15 ml/min) of an acidified solution (pH control to 2.2 with nitric acid) of aminoguanidine Hemisulfate (6.28 g) in distilled water (80 ml) to the sodium nitrite solution, with stirring. At this scale, the process time was 4 to 6 hours. A precipitate of tetrazene formed, which was filtered, washed with distilled water, with a final rinse of alcohol, and oven dried at 50° C. for 8 hours to afford tetrazene crystals. The product was confirmed as tetrazene by single crystal X-ray diffraction. The synthesised crystals were small (approximately 1 μm diameter), and agglomerated readily. A microscope image of the synthesised tetrazene crystals is shown in FIG. 1, while FIG. 2 shows the approximate particle size distribution of the synthesised tetrazene crystals.

Example 2: Preparation of Paraffin Wax Micro Particles

Paraffin wax micro particles were prepared by spray-cooling of molten paraffin wax (melting point ~65° C.). The paraffin wax used in these experiments was supplied by Sigma Aldrich as 20×10×5 cm bricks with a melting point of 53-57° C.

Figure 3:
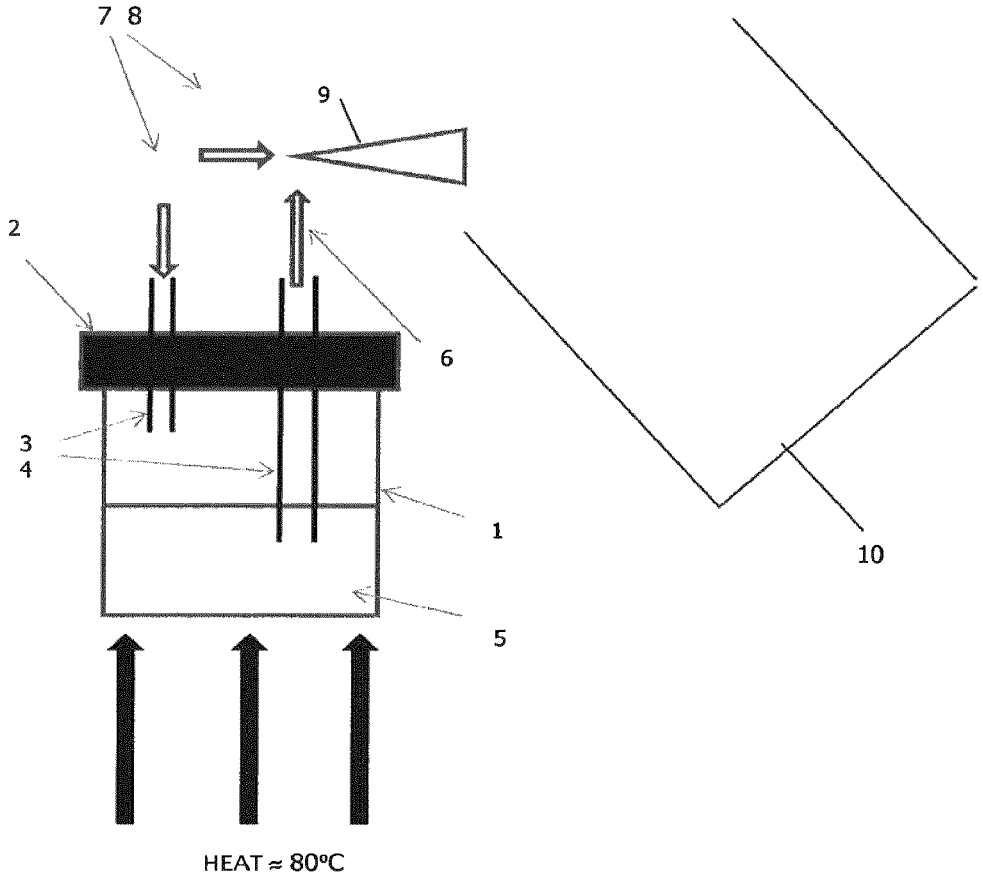
FIG. 3 shows a schematic of the equipment for producing paraffin wax powder by spray-condensation.

The equipment used for preparing the paraffin wax micro particles is shown in FIG. 3. The paraffin wax bricks are placed into a small glass beaker (1) sealed with a sealing lid (2) with two tubes (3, 4) in the lid, one of which (4) reaches into the wax. The beaker is heated to around 80° C. Once the wax has melted to form liquid paraffin wax (5), air jet (7) is forced into the beaker through tube (3), this in turn forces out a jet of liquid paraffin wax (6) through tube (4). The jet of hot liquid paraffin is disrupted sideways with another air jet (8) resulting in small particles of paraffin wax condensing in the air. The small particles of wax spray (9) are caught in a large glass beaker (10). The obtained paraffin wax micro particles were sieved through a 200 μm mesh to afford micro particles with a maximum particle diameter of 200 μm.

Figure 4:
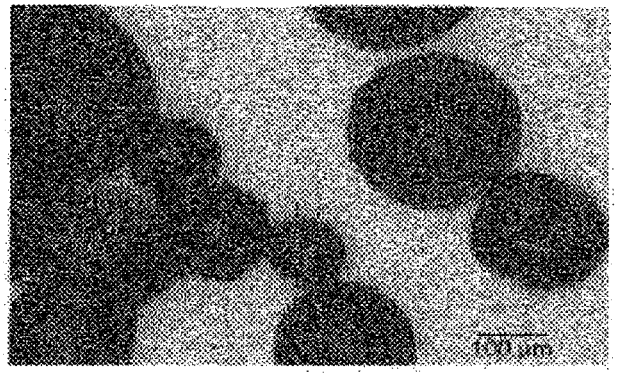
FIG. 4 shows a microscope image of the paraffin wax micro particles used in the explosive composition, prepared by spray-cooling of molten paraffin wax.

A microscope image of the paraffin wax micro particles is shown in FIG. 4. The particles are of a similar approximate size to the agglomerations of tetrazene crystals.

Example 3: Preparation and Packaging of the Composition

The tetrazene crystals (300 mg) as prepared in Example 1 and the paraffin wax micro particles (7.92 mg—equivalent to 5% wax by void less volume) as prepared in Example 2 were weighed out, and combined in a powder mixer. The resulting TW5 composition was packaged as a percussion primer for measurement. A plan view of the packaged TW5 composition is shown in FIG. 5A and a section view of the packaged TW5 composition is shown in FIG. 5B. A controlled quantity of the TW5 composition was weighed out, and pressed into a nickel-plated brass primer cup (11) to form the charge (11). A paper foil (13) was placed on top of the mixture, and the cup was sealed with a brass anvil (14). The anvil provides a crush-point for reliable ignition of the mixture.

Example 4: Pressure Measurement

Figure 6:
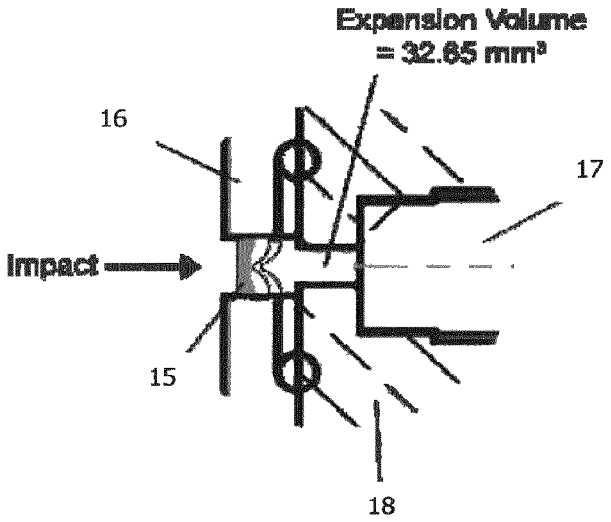
FIG. 6 shows a cross-sectional schematic of the experimental arrangement for pressure measurement.

A diagram of the experimental arrangement for the pressure measurement is shown in FIG. 6. The packaged TW5 composition (15) was placed in a sample mount (16). A Kistler 6215 pressure gauge (17) was mounted on a gauge mount (18) aligned faceon to the open face of a primer cup holding the packaged TW5 composition. The packaged TW5 composition was ignited by impact, and its gas-generating ability was measured in a closed cavity, with the mechanically shielded Kistler 6215 pressure gauge. The expansion volume was 32.65 $mm^3$.

Pressure measurements were taken of the TW5 composition and of the same mass of pure tetrazene packaged identically. The TW5 composition was also compared against the pressure-time profile of a commercial lead styphnate based primer composition. Pressure-time profiles were evaluated by peak pressure, pressure rise-time and repeatability of the pressure profile.

Ten pressure-time profiles of pure tetrazene and the TW5 composition were recorded. The resulting mean and standard deviation pressure-time profiles are shown in FIGS. 7 and 8 respectively.

Figure 7:
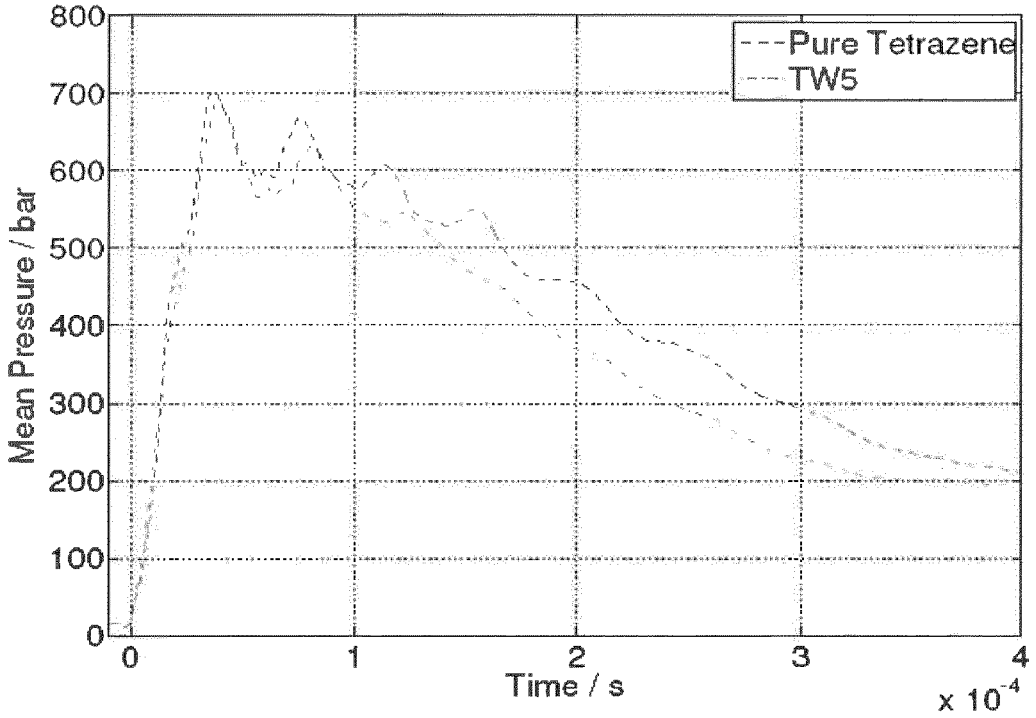
FIG. 7 shows the mean values of ten of ten pressure-time profiles of pure tetrazene and the explosive composition of the invention. The pure tetrazene peak mean pressure is 704 bar, with the peak mean pressure of the explosive composition of the invention slightly lower at 694 bar. The time to peak pressure for pure tetrazene is 37 μs and 39 μs for the explosive composition of the invention.
Figure 8:
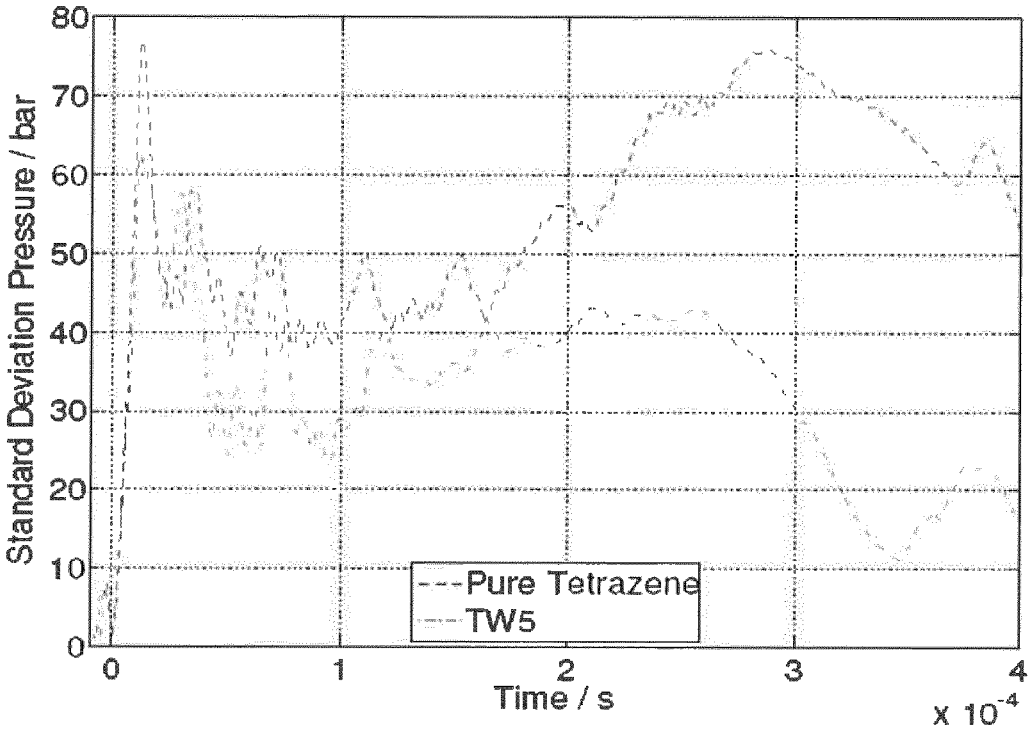
FIG. 8 shows the standard deviation of ten pressure-time profiles of pure tetrazene and the explosive composition of the invention.
Figure 9:
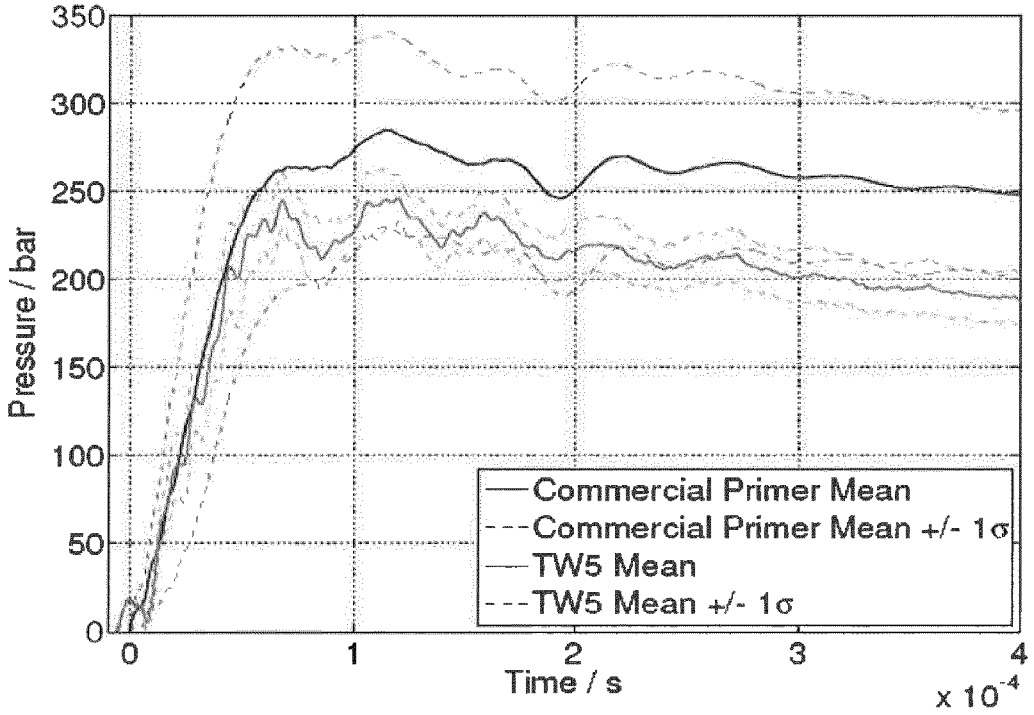
FIG. 9 shows the mean, and the mean±1 standard deviation (σ), of ten pressure-time profiles of the explosive composition of the invention and a commercial lead styphnate based primer composition.
Figure 10:
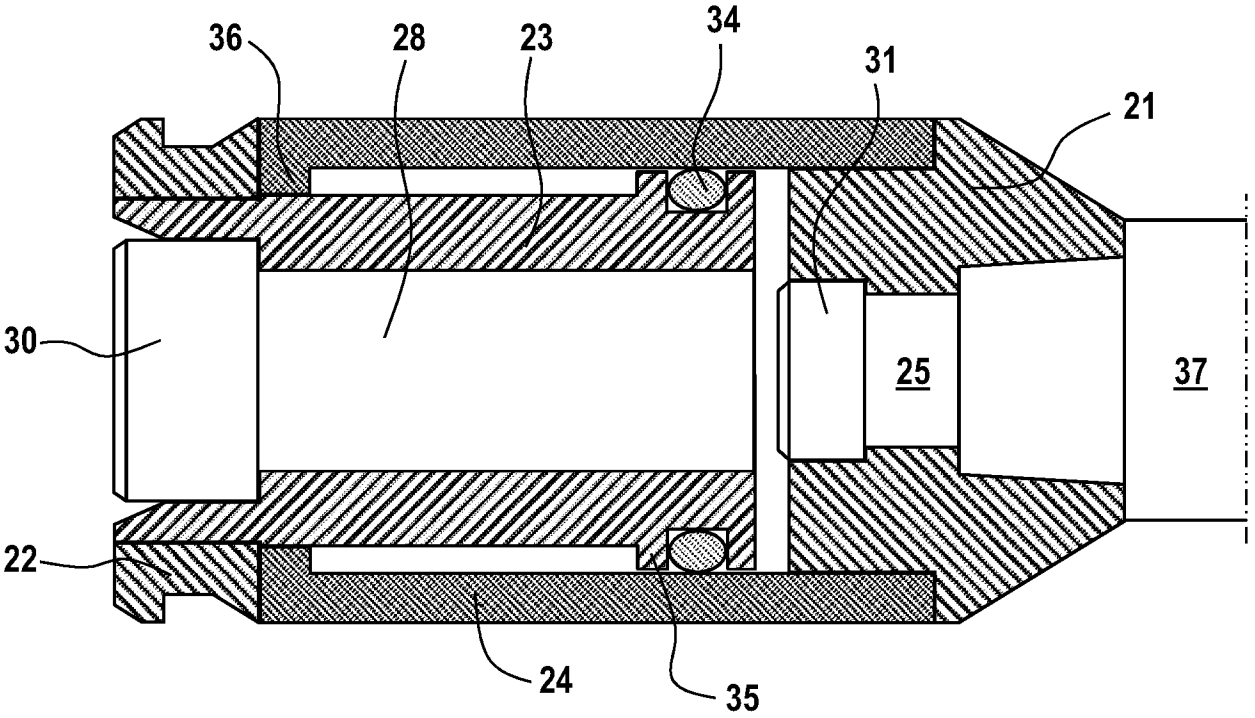
FIG. 10 shows a cartridge having a posterior portion having a primer and an anterior portion having an energetic material for propelling a projectile, where the primer or the energetic material employs the impact explosive of the present invention.

FIG. 7 show that the addition of paraffin wax has slightly reduced the peak pressure and gas-production rate. FIG. 8 show that the TW5 composition has a consistently lower standard deviation pressure than that of pure tetrazene. The addition of paraffin wax has resulted in more consistent gas-production, likely due to the reduced gas-production rate. A smaller quantity of the TW5 composition, packaged as before, was compared against a commercial lead styphnate primer composition. The mean of ten pressure-time profiles of both the TW5 composition and the commercial primer composition are shown in FIG. 9. The standard deviation about the mean is also shown.

The similarity of the mean pressure-time profiles in FIG. 9 shows that the TW5 composition can be used as a direct replacement for the lead styphnate based primer composition in a propulsion system. The standard deviation pressure of the TW5 composition is much smaller than the lead styphnate based primer composition, indicating that the gas-production process is more repeatable, resulting in more consistent propulsion speeds. Table 1 below summarises the mean and standard deviation velocities for a 270 mg projectile launched down a barrel by a lead styphnate based primer composition and the quantity of the TW5 composition shown in FIG. 9. As shown in Table 1, the mean velocities are almost the same, but the TW5 composition provides better repeatability.

TABLE 1

Mean and standard deviation muzzle velocities for a 2.7 g projectile down a barrel

| Propellant | Mean muzzle velocity/$ms^{-1}$ | Standard deviation muzzle velocity/$ms^{-1}$ |
|---|---|---|
| Commercial lead styphnate primer composition | 106 | 6.1 |
| TW5 composition | 105.6 ± 0.8 | 5.6 |

It is to be understood that the above Examples are merely exemplary of specific embodiments of the invention and that modifications can be made to those embodiments without departing from the scope of the invention.

The invention claimed is:

1. A cartridge for use in non-lethal applications comprising, an anterior portion and a posterior portion, the posterior portion comprising a movable element that is movable within the cartridge upon activation of a primer and the anterior portion being provided with a nose portion which is suitable for receiving a projectile, and a source of energetic material located in the anterior portion, the energetic material being initiatable by a reaction produced on activation of the primer to cause propulsion of the projectile from the cartridge, wherein either the primer, or the source of energetic material, or both the primer and the source of energetic material include an explosive composition having tetrazene and paraffin, wherein the paraffin wax is formed as micro particles, wherein the paraffin wax micro particles have particle diameters in the range of about 0.5 μm to about 500 μm in diameter.

2. The cartridge of claim 1, wherein the paraffin wax micro particles have particle diameters in the range of about 20 μm to about 200 μm in diameter.

3. The cartridge of claim 1, wherein the micro particles have been prepared by a process of spray-cooling or spray congealing of molten paraffin wax.

4. The cartridge of claim 1, wherein the explosive composition further comprises from about 1% to about 50% of paraffin wax by void less volume.

5. The cartridge of claim 4, wherein the composition comprises from about 4.5% to about 5.5% of paraffin wax by void less volume.

6. The cartridge of claim 1, wherein the explosive composition is substantially free from lead.

7. The cartridge of claim 1, wherein the explosive composition is substantially free from metals and metal compounds.

8. The cartridge of claim 1, wherein the explosive composition is substantially free from perchlorate salts.

9. The cartridge of claim 1, wherein the cartridge is a telescopically expanding training cartridge, and wherein the explosive composition is employed as the primer and/or as the source of energetic material therein.

10. The cartridge of claim 1, wherein the cartridge is a telescopically expanding training cartridge, and wherein the explosive composition is used to propel the projectile therefrom.

11. A cartridge for use in non-lethal applications, comprising a primer and a source of energetic material, wherein the source of energetic material being initiatable by a reaction produced on activation of the primer, wherein either the primer, the source of energetic material, or both the primer and the source of energetic material include an explosive composition having tetrazene and paraffin wax, wherein the paraffin wax is present in the form of micro particles, wherein the paraffin wax micro particles have particle diameters in the range of about 0.5 μm to about 500 μm in diameter.

12. The cartridge of claim 11, wherein the paraffin wax micro particles have particle diameters in the range of about 20 μm to about 200 μm in diameter.

13. The cartridge of claim 11, wherein the micro particles have been prepared by a process of spray-cooling or spray congealing of molten paraffin wax.

14. The cartridge of claim 11, wherein the explosive composition further comprises from about 1% to about 50% of paraffin wax by void less volume.

15. The cartridge of claim 11, wherein the explosive composition is substantially free from lead.

* * * * *